US008241396B2

(12) United States Patent
Ursem et al.

(10) Patent No.: US 8,241,396 B2
(45) Date of Patent: Aug. 14, 2012

(54) REMOVAL OF SMUT, DUST AND EXHAUST GAS PARTICLES WITH PARTICLE CATCH ARRANGEMENT USING STATIC ELECTRIC FIELD

(75) Inventors: Willibrordus Nicolaas Johannes Ursem, Hellevoetsluis (NL); Johannes Cornelis Maria Marijnissen, Breda (NL); Rein Andre Roos, Noce (FR)

(73) Assignee: Technische Universiteit Delft, Delft (NL)

( * ) Notice: Subject to any disclaimer, the term of this patent is extended or adjusted under 35 U.S.C. 154(b) by 870 days.

(21) Appl. No.: 12/281,398

(22) PCT Filed: Mar. 2, 2007

(86) PCT No.: PCT/NL2007/050086

§ 371 (c)(1),
(2), (4) Date: Dec. 29, 2008

(87) PCT Pub. No.: WO2007/100254

PCT Pub. Date: Sep. 7, 2007

(65) Prior Publication Data

US 2009/0277329 A1 Nov. 12, 2009

(30) Foreign Application Priority Data

Mar. 2, 2006 (EP) ..... 06110610

(51) Int. Cl.
*B03C 3/38* (2006.01)

(52) U.S. Cl. ..... 95/59; 95/61; 95/75; 96/30; 96/44; 96/50; 96/68; 96/98; 404/76; 404/83

(58) Field of Classification Search ..... 95/59, 61, 95/68, 75; 96/30, 31, 44, 50, 68, 69, 96, 96/98, 99; 404/72, 75, 76, 83, 92
See application file for complete search history.

(56) References Cited

U.S. PATENT DOCUMENTS 2,490,979 A * 12/1949 Palmer ..... 96/31
3,434,267 A 3/1969 Messen-Jaschin (Continued)

FOREIGN PATENT DOCUMENTS

DE 19648182 A1 5/1998

(Continued)

OTHER PUBLICATIONS

Nikas, et al.,"Numerical simulation of the flow and the collection mechanisms inside a laboratory scale electrostatic precipitator," Journal of Electrostatics, 2005, pp. 423-443, vol. 63 No. 5, Elsevier Science Publishers, Amsterdam.

(Continued)

*Primary Examiner* — Richard L Chiesa
(74) *Attorney, Agent, or Firm* — Foley & Lardner LLP; Gilberto M. Villacorta; Sunit Talapatra

(57) ABSTRACT

This inventions provides a method for the removal of smut, fine dust and exhaust gas particles from polluted air including providing a particle catch arrangement with a charged surface, the particle catch arrangement being arranged to generate a static electric field, wherein the electric field is at least 0.2 kV/m. The invention further provides a particle catch arrangement including a surface that can be charged, further including a generator arranged to generate charge to the surface that can be charged and to generate a static electric field of at least 0.2 kV/m, wherein the particle catch arrangement is part of or integrated with an object including street furniture.

24 Claims, 7 Drawing Sheets

U.S. PATENT DOCUMENTS

Figure 1:
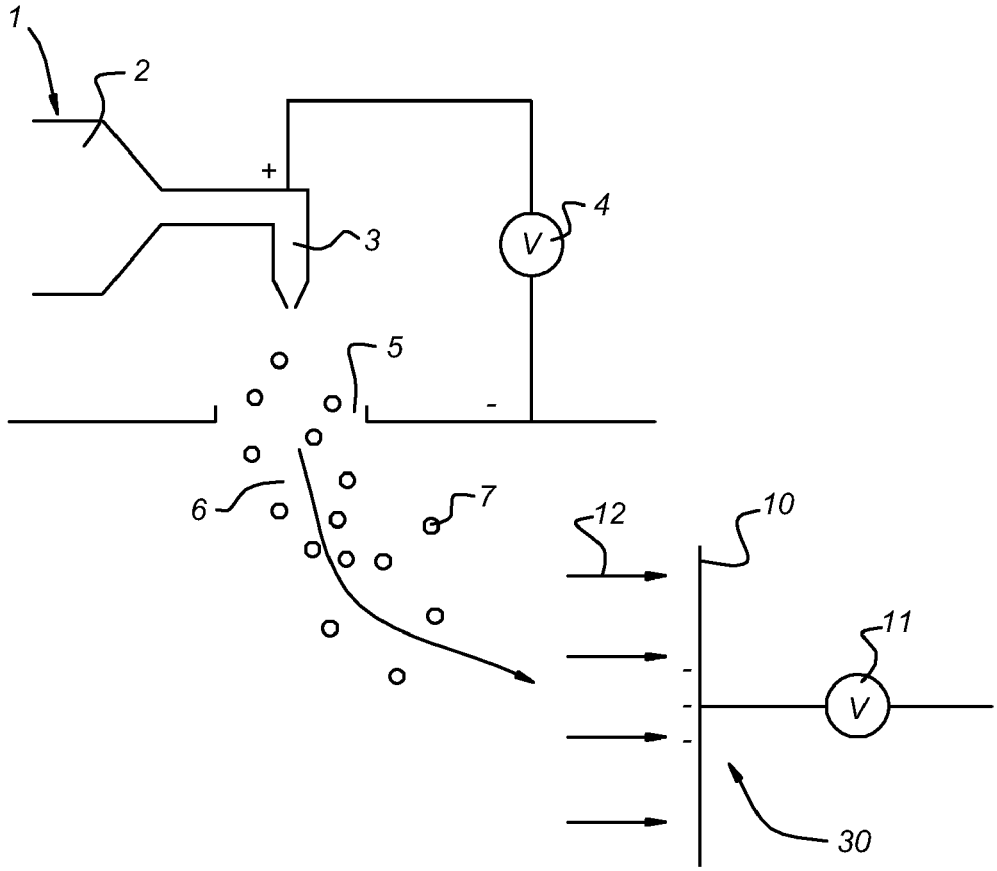

| | | | | |
|---|---|---|---|---|
| 3,785,124 | A * | 1/1974 | Gaylord | 96/19 |
| 3,791,752 | A | 2/1974 | Gardner | |
| 5,069,693 | A | 12/1991 | Blikken et al. | |
| 5,707,171 | A * | 1/1998 | Zaleski et al. | 404/28 |
| 5,993,521 | A * | 11/1999 | Loreth et al. | 96/69 |
| 6,106,592 | A | 8/2000 | Paranjpe et al. | |
| 6,241,810 | B1 * | 6/2001 | Wikstrom et al. | 96/69 |
| 6,511,258 | B1 | 1/2003 | Johnsen | |
| 7,001,447 | B1 * | 2/2006 | Altman et al. | 95/74 |
| 7,294,169 | B2 * | 11/2007 | Taylor | 95/2 |
| 2004/0226448 | A1 * | 11/2004 | Griffiths et al. | 96/67 |

FOREIGN PATENT DOCUMENTS

| | | | |
|---|---|---|---|
| EP | 0808660 | A | 11/1997 |
| JP | 2002-069943 | | 3/2002 |

OTHER PUBLICATIONS

International Search Report for PCT/NL2007/050086, dated Jun. 6, 2007, 3 pages.

* cited by examiner

REMOVAL OF SMUT, DUST AND EXHAUST GAS PARTICLES WITH PARTICLE CATCH ARRANGEMENT USING STATIC ELECTRIC FIELD

FIELD OF THE INVENTION

The present invention relates to a method for the removal of smut, fine dust and exhaust gas particles from polluted air. The invention further relates to a particle catch arrangement comprising a surface that can be charged. The invention also relates to the use of a particle catch arrangement comprising a charged surface arranged to generate a static electric field for collecting smut, fine dust and exhaust gas particles in polluted air.

BACKGROUND OF THE INVENTION

Smut particles, fine dust and exhaust gas particles of traffic are a source of pollution with undesired consequences on public health. In order to prevent the exhaust of such particles or in order to remove the exhausted particles, a number of methods are known in the art. For instance, smut filters and catalysts can be used in exhaust systems to reduce the exhaust of such particles. Nevertheless, there may still be some emission of those particles.

Other solutions are for instance described in U.S. Pat. No. 6,511,258 and JP2002069943. U.S. Pat. No. 6,511,258 describes a method for controlling the amount of ionized gases and/or particles suspended in the air above roads, streets, open spaces or the like. This is done by establishing an electrical field between the top layer of a road, street, open space or the like, and the ionized gases and/or particles. By controlling the electrical field the amount of ionized gases and/or particles can be controlled, which are attracted or repelled. The electrical field is established by making at least the top layer of the surface concerned electrically conductive and connecting it to earth or to one pole of an electrical voltage source. In order to make the surface electrically charged, a network of conductive metal or a piezoelectric material is employed under the top layer which is placed in contact with earth or a negative voltage source. The electrically charged top layer may also be composed of a coating which is laid on top of the entire or parts of the surface, for example in the form of road marking or the like. This solution provided by U.S. Pat. No. 6,511,258 is a rather complicated solution that has the disadvantage that only positively charged particles are caught at the surface. JP2002069943 describes a soundproof wall arranged at the side of a road which is constituted of a mesh internal wall capable of leading exhaust gas to the inside of the soundproof wall, an external wall arranged at the outside of the road, and a vibrating device housing particles in the space defined between the internal wall and the external wall and vibrating the particles in order to adsorb the suspended materials by static electricity generated among the particles. This is also a relatively complicated solution which has further the disadvantage that it may only remove particles that are present or have migrated into the wall and does not remove remote pollution particles.

U.S. Pat. No. 6,106,592 describes a gas cleaning process and apparatus for removing solid and liquid aerosols entrained in a gas stream. The gas to be treated is passed through a wetted, electrostatic ally charged filter media. The polarity of the electrostatic charge on the filter media is selected to enhance the removal of captured solid particles from the filter media. The apparatus is readily adaptable to a modular gas cleaning system configuration wherein varying numbers of the apparatus may be operated in parallel to provide a gas cleaning system of any desired gas flow capacity. Fields of 80-800 kV/m are applied.

DE19648182 describes that to homogenize the electric field in a filter channel, that is defined by two precipitation electrodes, of a filter structure for the separation of dust like or drop-shaped impurities from a flow of gas, corona electrodes are used. These are plate formed—e.g. designed with a central plate and with edge plates projecting on opposite sides and joining front and back in an obtuse angle—and have, on the front and back edge, an in each case continuous area of curvature produced by beading, with a radius of curvature of 2-5 mm. The areas of curvature show, throughout their length, an approximately uniform curvature and constitute the laterally most protuberant parts. By the average distance of consecutive areas of curvature and the formation of the same, the production of charge carriers for electrostatic cleaning can be controlled and, in particular, overproduction of the same, which favours back spray, can be prevented. Corona formation occurs exclusively during voltage impulses and only at the areas of curvature. A field of 240 kV/m is applied.

EP0808660 describes a dust collector which can collect dust, especially fine dust (submicron particles). The dust collector, which removes dust and/or mist contained in a gas, comprises a charging means for charging dust and/or mist contained in a gas, a spraying means for spraying the charged dust or charged mist or spraying a dielectric material to the charged dust or mist, an electric field forming means for forming an electric field for subjecting the dielectric material to dielectric polarization, and a collecting means for collecting the dielectric material which have arrested at least either of the charged dust and charged mist. A field of 500 kV/m is applied.

SUMMARY OF THE INVENTION

It is an object of the invention to provide an alternative, preferably better, solution to the problem of removal of pollution particles such as for instance smut particles, fine dust and exhaust gas particles. It is especially an object of the invention to provide an alternative, preferably better, solution to the problem of removal of pollution particles, such as for instance smut particles, fine dust and exhaust gas particles in air over geographical objects, such as selected from the group consisting of a road, an open place and a built-on area.

According to a first aspect of the invention, there is provided a method for the removal of smut, fine dust and exhaust gas particles from polluted air comprising: providing a particle catch arrangement with a charged surface, preferably negatively charged, the particle catch arrangement being arranged to generate a static electric field, wherein the electric field is at least 0.2 kV/m. In a specific embodiment, there is provided a method for the removal of smut, fine dust and exhaust gas particles from polluted air comprising providing a particle catch arrangement with a charged surface, the particle catch arrangement arranged to generate a static electric field, atomize (i.e. ionize) at least part of the smut, fine dust and exhaust gas particles in the polluted air, and collect at least part of the smut, fine dust and exhaust gas particles, wherein the electric field is at least 0.2 kV/m.

In a specific embodiment, the electric field is preferably in the range of 0.2-50 kV/m.

In an embodiment, the particle catch arrangement comprises a first object, and the method comprises applying a positive charge to a surface of the first object, thereby providing a positively charged surface. Due to the presence of the positively charged surface, positively ionized particles move away to the earth or an other object, especially earthed or negatively charged objects, and are collected there. At least part of the total number of smut, fine dust and exhaust gas particles in the polluted air in the electric field that are not ionized, will be ionized with a positive charge, and may therefore also be collected. Hence, in this way a method for the removal of smut, fine dust and exhaust gas particles from polluted air is provided. The pollution particles cannot easily move far away from their "position", but are collected at negatively charged or earthed surfaces due to the presence of the electric field.

In a preferred embodiment, the particle catch arrangement further comprises a second object, and the method further comprises applying a negative charge to a surface of the second object, thereby providing a negatively charged surface. Due to the field, the ionized particles are drawn to the negatively charged surface, and are thereby collected and removed from the air above the road (open place, etc.). An advantage of this method (and arrangement) is that pollution may deliberately deposited on the negatively charged surface of the second object. The first object and/or the second object may be part of or integrated with (existing) street furniture.

In yet another preferred embodiment, the surface of the first object is arranged at a larger height than the surface of the second object. Preferably, the surface of the first object, positively charged, is arranged well above the area above which the are is to be cleaned, for instance at least 4.5 m, more preferably at least 5 m, above such area (the height calculated relative to the area below the charged surface of the first object). Characteristic heights will be in the range of 4.5-20 m, more preferably 5-10 m. In this way, the relatively more dangerous positive electrode (i.e. the positively charged surface of the first object) is at a safe position; the substantially not dangerous counter electrode (i.e. the surface of the second object) may be lower. The electric field provides a kind of "roof" under which pollution particles are substantially kept and transported to the counter electrode. In other words, the electric field provides a kind of ionized particle cloud, wherein the pollution particles are substantially kept and transported to the counter electrode. The counter electrode may be neutral, but is preferably negatively charged.

The method of the invention may especially be applied, i.e. the static electric field may especially be applied, over at least part of one or more geographical objects selected from the group consisting of a road, an open place and a built-on area.

According to yet a next aspect of the invention, there is provided a particle catch arrangement comprising a surface that can be charged, further comprising a generator arranged to generate charge to the surface that can be charged and to generate a static electric field of at least 0.2 kV/m, wherein the particle catch arrangement is part of or integrated with an object comprising street furniture. During operation, the particle catch arrangement generates the static electric field.

According to yet another aspect of the invention, there is provided a particle catch arrangement comprising a first object with a surface that can be charged, a second object with a surface that can be charged, a generator arranged to generate a positive charge to the first object's surface that can be charged and optionally a negative charge to the second object's surface that can be charged and to generate a static electric field of at least 0.2 kV/m between the surfaces, wherein at least part of the particle catch arrangement is part of or integrated with an object comprising street furniture, for instance a sound barrier, a crash barrier, a tunnel wall, a road sign, a traffic information system, a street lamp or a traffic light. During operation, the particle catch arrangement generates the static electric field and the surface of the first object is positively charged; the surface of the second object may be grounded or negatively charged during operation.

The particle catch arrangement may be part of or be integrated with part of the street furniture object such as for instance an object selected from the group consisting of a sound barrier, a crash barrier, a tunnel wall, a road sign, a traffic information system, a street lamp and a traffic light. However, also other or specially for the purpose of the invention designed street furniture may be applied herein. For instance, the surface may be located on a street lamp or on for instance wires between street lamps, etc., but may also be located on for the purpose of the invention designed posts or on for instance wires between such posts, which posts have only a function as enabling that a surface that can be charged during operation, especially the positively charged surface, can be arranged over a road, etc.

According to another aspect of the invention, the invention enables the use of a particle catch arrangement comprising a charged surface arranged to generate a static electric field for collecting smut, fine dust and exhaust gas particles in polluted air, wherein the electric field is at least 0.2 kV/m. In a specific embodiment, the invention enables the use of a particle catch arrangement with a charged surface arranged to generate a static electric field for atomizing (i.e. ionizing) smut, fine dust and exhaust gas particles in polluted air, wherein the electric field is at least 0.2 kV/m, and removing at least smut, fine dust and exhaust gas particles from the polluted air.

The invention especially provides the use of a particle catch arrangement comprising a charged surface (during operation) arranged to generate a static electric field for collecting smut, fine dust and exhaust gas particles in polluted air, wherein the electric field is at least 0.2 kV/m.

In a preferred embodiment, the invention provides the use of a particle catch arrangement according to the invention for collecting one or more of smut, fine dust and exhaust gas particles in polluted air over a geographical object selected from the group consisting of a road, an open place and a built-on area.

According to another aspect of the invention, the invention provides a combination of a road and a particle catch arrangement according to the invention, wherein the particle catch arrangement is arranged to apply an electric field over at least part of the road.

Advantageously, the invention may solve the problem of removing pollution particles that are remote from the particle catch arrangement in contrast to prior art solutions. For instance, with the method and particle catch arrangement of the invention, it is possible to remove pollutant particles which are at distance of for example 0.5-20 meters. The particles are atomized (i.e. ionized), and are drawn due to the electric field to the particle catch arrangement, especially to the negatively charged surface of the particle catch arrangement. There the particles may contact the surface and may be collected ("harvested").

DETAILED DESCRIPTION

Herein, the term "atomization" refers to the process of ionization of particles with an electrical dipole moment or inducing an electrical dipole in a neutral particle (like fine dust, smut, etc.). Both processes may take place at a distance, i.e. the particle that is atomized is not attached to the charged surface of the particle catch arrangement. In the invention, positively charged ionized particles, radicals or neutral atomized particles are assumed. Negatively charged particles or negatively ionized particles tend to scavenge radicals and positively charged particles in the air, thereby forming neutral particles. These neutralized particles can again according to the herein used principle of atomization be atomized, and obtain thereby an intrinsic electric charge and direction (for instance to a negatively charged surface). At least part of the pollution particles may be positively charged even without an electric field. Due to the presence of the electric field, at least part of the total number of pollution particles is transported to a neutral or negative charged surface, preferably a negative charged surface. At least part of the pollution particles which are not ionized may be ionized by the electric field, and thus at least part of the total number of these ionized particles may also be transported to a neutral or negative charged surface, preferably a negative charged surface.

Herein the term "smut" especially refers to carbon black or soot that is for instance emitted by trucks, busses, planes, trains and automobiles, etc, especially by present diesel based engines. The term "fine dust" refers to air-borne solid particles, originating from human activity and natural sources, such as wind-blown soil, fires, trucks, busses, planes, trains and automobiles that eventually settle through the force of gravity, and can cause injury to human and other animal respiratory systems through (excessive) inhalation. It may also comprise smut. The term "exhaust gas particles" refers to smut, fine dust, etc. particles, that are emitted by exhaust from engines, for instance from trucks, busses, planes, trains and automobiles. Smut, fine dust and exhaust gas particles are herein also indicated as "pollution particles". Herein, the phrase smut, "smut, fine dust and exhaust gas particles" implies one or more selected from the group consisting of smut, fine dust and exhaust gas particles.

According to an aspect of the invention, there is provided a method for the removal of smut, fine dust and exhaust gas particles from polluted air comprising providing a particle catch arrangement with a charged surface, the particle catch arrangement being arranged to generate a static electric field, wherein the electric field is at least 0.2 kV/m, preferably in the range of 0.2-50 kV/m, more preferably 0.5-45 kV/m, even more preferably 10-40 kV/m. A generator charges the surface such that a charged surface and thereby the electric field is obtained. Preferably the electric field is in the range of 0.2-2.5 kV/m, such as in the range of about 0.5-2.5 kV/m; even more preferably at least about 1.25 kV/m. According to an embodiment, a voltage of 1-50 kV is applied to the charged surface, preferably 1.5-50 kV, more preferably about 1.5-45 kV, even more preferably about 2-45 kV, yet even more preferably 2-40 kV. This means that a voltage of 1-50 kV, preferably 1.5-50 kV, more preferably about 1.5-45 kV, even more preferably about 2-40 kV is applied to the surface, such that a charged surface is created and an electric field of at least 0.2 kV/m, more preferably in the range of about 0.5-2.5 kV/m, even more preferably at least about 1.25 kV/m, is generated. The particle catch arrangement comprises a generator designed to generate a static electric field. Such generators are known to the person skilled in the art. Advantageously, by generating an induced static electric field, at a distance particles are ionized and subsequently settle on the charged surface (i.e. a negatively charged surface or optionally an earthed surface). Preferably, the charged surface is negatively charged, although this surface may in an embodiment also be earthed (grounded). Distances of about 0.5-20 m may be bridged, more preferably ionization of the pollution particles may take place over a distance of 1-20 m. Preferably, the particle catch arrangement is arranged such and the field is applied such that at least part of the total amount of pollution particles at a distance of at least 0.5 m, more preferably at least 1 m, even more preferably at least 1.5 m are ionized and drawn to the negatively charged surface.

Due to the ionization of smut, dust particles and exhaust gas particles on a distance are actively charged and attracted and caught by the particle catch arrangement (i.e. are attracted by the charged surface). The invention advantageously provides catching smut, fine dust and exhaust gases by ionizing particles, which will be charged and directed in an electric field with high voltages. The charging and direction is such that particles in this field will move and deposit at the charged surface of the particle catch or cleaning arrangement. In this way, the particles are collected and removed from the polluted air above for instance a road. Herein the term "road" also includes streets, open places, etc (see also below). Hence, in this invention the generator does not charge the surface of a road, as may be the case in U.S. Pat. No. 6,511,258. Here, street furniture alongside or over the road comprise the particle catch arrangement and an electric field is generated over the road, street, open place, etc.

The principle of ionizing of particles on a distance, and by that creating a direction, for catching smut, fine dust and exhaust particles is new and has never been utilized as such before. As far as known by the inventor, all known actual and prepared systems caught mentioned particles in a passive manner. For instance, JP2002069943 concerns a sound killer with internal cavities, where particles are absorbed by internal static electricity. Hence, the particles may be ionized when inside the cavities of the sound barrier itself and not on a distance. U.S. Pat. No. 6,511,258 concerns an electric charged road surface in contact with the earth as negative source. Hence, only positive charged dust particles can be attracted. This is essentially different, because ionization may thus only takes place at the road surface and not at a distance. Furthermore, the road surface is negative or zero, and therefore it can catch in principle only positive charged particles and not all particles. In the present invention, substantially all pollution particles are ionized on a distance, and will once be caught by the particle catch arrangement. $NO_x$, when hydrated may be ionized on a distance and may be attracted in the same manner. U.S. Pat. No. 6,511,258 describes a system with an earthed road, with static electricity, and with a relative low voltage, which system does not lead to an ionization at distance. The particle catch arrangement of the invention, however, is arranged to ionize particles at a distance, with a positively charged surface ("initiating" or "generating" surface") and a negatively charged or earthed surface (the "collecting" or "harvesting" surface).

In a specific embodiment, the electric field is applied over at least part of a road. In this way, exhaust particles, etc. from traffic may be caught, thereby improving the local environment. The particle catch arrangement with charged surface may be positioned at intervals along the road, such that over a complete section of the road pollution particles can be scavenged by the particle catcher.

In a specific embodiment, the method of the invention further comprises washing the surface of the particle catch arrangement. Here is referred to the surface of the particle catch arrangement that is charged (especially the negatively charged surface). To this end, the particle catch arrangement may be equipped with a spraying system, but preferably natural rain water is used. To this end, the surface is arranged with an angle relative to a normal to the earth's surface larger than 0° and smaller than 90°, preferably between about 10 and 80°. Therefore, rain water flows over the (charged) surface due to gravity, and washes the surface. In this way, particles collected on the surface may be collected below the surface, for instance in a gutter. Instead of a gutter, or within a gutter, an adsorbent may be provided, for instance charcoal, a zeolite, porous alumina, etc., as will be known in the art, for adsorption of the particles which, due to (for instance) gravity, migrate downwards. Hence, in a specific embodiment there is provided an adsorbent, arranged to collect at least part of the smut, fine dust and exhaust gas particles. Such adsorbent may be replaced with a fresh adsorbent when the adsorption capacity decreases too much. This may for instance be done at regular intervals. Therefore, in a specific embodiment a gutter or an adsorbent, or an adsorbent in a gutter are arranged comprised in the particle catch arrangement and are arranged below the charged surface, respectively. This is especially advantageous for application to the surface of the object that is grounded or negatively charged during operation.

In an embodiment, the particle catch arrangement comprises a first object, and the method comprises applying a positive charge to a surface of the first object, thereby providing a positively charged surface. Due to the presence of the positively charged surface, positively ionized particles move away to the earth or an other object, especially earthed or negatively charged objects, and are collected there. At least part of the total number of particles in the electric field that are not ionized, will be ionized with a positive charge, and may therefore also be collected. Hence, in this way a method for the removal of smut, fine dust and exhaust gas particles from polluted air is provided.

In a preferred embodiment, the particle catch arrangement further comprises a second object, and the method further comprises applying a negative charge to a surface of the second object, thereby providing a negatively charged surface. Due to the field, the ionized particles are drawn to the negatively charged surface, and are thereby collected and removed from the air above the road (open place, etc.). An advantage of this method (and arrangement) is that pollution may deliberately deposited on the negatively charged surface of the second object.

Hence, herein the potential at the first object's surface is higher than the potential at the second object's surface. The first object's surface is arranged to initiate and generate the electric field/ionization and the second object's surface is arranged to collect or harvest the pollution particles. The second object's surface can also be indicated as counter electrode. The potential difference between the generating surface and the collecting surface causes build up of space-charge, particularly in the volume between the surfaces. Space-charge is the excess of electrons or ions in a given volume.

Herein, the invention applies at least a charged surface. This may either be a positively charged surface, or a negatively charged surface. In case of a positively charged surface, a counter surface (counter electrode) may be negative or earthed, preferably negative. Preferably arrangements are chosen wherein a positively and a negatively charged surface are applied and air, as a kind of dielectric, is at least partially cleaned from pollution particles. The objects bearing the charged surfaces are for the sake of understanding herein also indicated as first object (having a surface that can be charged positively) and a second object (having a surface that can be charged negatively). Preferably, at least one of these objects is integrated with or part of street furniture, especially street furniture such as described herein. The charged surface, especially the positively charged surface is preferably arranged at a height of at least 5 m over a geographical object, such as selected from the group consisting of a road, an open place and a built-on area.

The term "road" includes streets, ways, avenues, motorway, freeway, lanes, alleys, pathways, tracks, railways, footpaths, promenades, runways, airstrips, etc., as will be clear to the person skilled in the art. The term road further includes optional central reservations (median strips) and roadsides (verges). The term "open place" includes market squares, village squares, plazas, greens, fields, sport fields, etc., as will be clear to the person skilled in the art. Some of these "open places", such as squares, may also be a road. The term "built-on area" relates to any area with buildings, such as houses, department stores, apartment buildings, industrialized area's, etc., as will be clear to the person skilled in the art. The term "geographical object" preferably relates to areas where motorized vehicles which pollute the air with smut, fine dust and/or exhaust particles, or other smut, fine dust and/or exhaust particles emitters (engines, plants, etc.) can drive or are found.

In a specific embodiment, the charges are temporarily changed in sign for cleaning the surface of the second object. For instance, the sign may be changed for about 0.1-10 minutes once a day or once a week. Collected pollution will now be removed from the counter electrode, due to the ionization. These pollution particles may than, due to gravity drop, for instance in a gutter (see below). This change of sign may especially be applied during rainfall. The change of sign may be applied in a frequency between for instance once a day and once a week According to a next aspect of the invention, there is provided a particle catch arrangement comprising a surface that can be charged, further comprising a generator arranged to generate charge to the surface that can be charged and to generate a static electric field of at least 0.2 kV/m, wherein the particle catch arrangement is part of or integrated with an object comprising street furniture. In an embodiment, the street furniture object is selected from the group consisting of a sound barrier, a crash barrier, a tunnel wall, a road sign, a traffic information system, a street lamp and a traffic light. As mentioned above, the charged surface is preferably negatively charged (during operation). Herein, the term "tunnel" includes for instance tunnels and fly-overs.

In an embodiment, the surface is positively charged. In that case, the particle catch arrangement further comprises a negatively charged or grounded counter electrode. As described herein, the counter electrode is an object with a surface that is negatively charged or grounded, respectively. In a further embodiment, the particle catch arrangement further comprises a second object, wherein the surface of the second object is grounded, and wherein the surface of the second object is preferably the surface of a wire, a wire mesh, an antenna or a needle.

According to yet another aspect of the invention, there is provided a particle catch arrangement comprising a first object with a surface that can be charged, a second object with a surface that can be charged, a generator arranged to generate a positive charge to the first object's surface that can be charged and a negative charge to the second object's surface that can be charged and to generate a static electric field of at least 0.2 kV/m between the surfaces, wherein at least part of the particle catch arrangement is part of or integrated with an object comprising street furniture, for instance a sound barrier, a crash barrier, a tunnel wall, a road sign, a traffic information system, a street lamp or a traffic light.

In an embodiment, the particle catch arrangement further comprises one or more detectors arranged to measure wind speed and/or wind direction (and optionally other parameters, see below). The signal of the detector(s) may be used by a processor for controlling the applied field. For instance, in case the wind direction is directed from the charged surface, the voltage may be increased, whereas in case the direction is to the charged surface, a lower voltage may suffice. Hence, in a specific embodiment, the particle catch arrangement further comprises a computer arranged to control the method according invention and optionally control the value and/or direction of the electrical field as a function of the wind speed and/or direction. Hence, in a further specific embodiment, a computer program product is provided comprising a computer executable code which, when loaded on a computer, provide the computer with the functionality of controlling the value and/or direction of the electrical field of the particle catch arrangement, especially with the functionality of controlling the value and/or direction of the electrical field as a function of the wind speed and/or direction. Herein, terms such as "value and/or direction" are identical to terms such as "one or more selected of the group consisting of value and direction". Hence, in a further specific embodiment, a computer program product is provided comprising a computer executable code which, when loaded on a computer, provide the computer with the functionality of controlling the method of the invention, especially with the functionality of controlling method of the invention as a function of the wind speed and/or direction. As will be clear to the person skilled in the art, this may imply that the particle catch arrangement comprises a computer, detectors for detecting wind speed and wind direction, etc, which detectors are in communication with the computer and which computer communicates with a generator or power supply for charging a surface and optionally with a detector for measuring the electric field strength.

In a further embodiment, there is provided a computer program product comprising a computer executable code which, when loaded on a computer, provide the computer with the functionality of controlling one or more selected from the group consisting of the value and direction of the electrical field of the particle catch arrangement according to the invention as a function of one or more selected from the group consisting of the wind speed and direction, humidity (of the air), pollution concentration, traffic density, pollution on a charged surface, and time. Hence, the particle catch arrangement may further comprise one or more sensors selected from the group consisting of sensors for sensing wind speed and direction, humidity, pollution concentration, traffic density, pollution on a charged surface, and time (or optional a clock), respectively. The cleaning method may be controlled depending upon the input signal of these sensors. For instance, when there is no traffic, the voltage may be reduced (to zero), or with heavy traffic, the voltage may be increased.

The particle catch arrangement may for instance comprise a conducting plate or needle for instance attached to an object like a sound killer (sound barrier) or other street furniture along roads. In an embodiment, the charged surface comprises a circular or parabolic shaped surface, the surface of a plate (i.e. flat or substantially flat), the surface of a needle or the surface of a wire mesh. The plate, needle, circular or parabolic shaped item, wire mesh or other shapes known to the person skilled in the art, comprise an electric chargeable material, such as metals, carbon or other conducting materials. Such material may be coated or otherwise applied onto the traffic furniture object or to at least part of the particle catch arrangement. Preferably the surface, especially the negatively charged surface, has no sharp curvatures in order to prevent corona effects, which are less desired since smut particles, fine dust and exhaust gases whirl up along the electric charged material due to corona effects. Hence, in case needle like surfaces or other curved surfaces are used, the curvatures thereof are preferably blunt. Needles with a greater top surface or a blunt point emerge no corona effects and ionized smut particles, fine dust and exhaust gases will deposited on the electric charged material on the sound killer or on other electric charged street furniture along roads. However, when the surface is grounded (i.e. when the surface of the second object is grounded), the surface is preferably arranged to allow corona effects during operation of the particle catch arrangement. Preferably, grounded surfaces are surfaces of one or more objects selected from the group consisting of a wire, a wire mesh, a (sharp) needle, an antenna etc. The term "antenna" herein especially refers to a wire antenna. As will be clear to the person skilled in the art the phrase "a wire, a wire mesh, a (sharp) needle, an antenna etc." also refers to a plurality of wires, wire meshes, (sharp) needles, antennas etc., respectively. Combinations of two or more of such surfaces may be applied. The wire may be a straight or curved wire, but may also be a circular or parabolic wire.

In a specific embodiment, the conducting material comprises a plate having a surface of at least 0.01 $m^2$, preferably at least 0.1 $m^2$. Preferably, the surface to be charged (positive or negative) comprises a material that is conductive. Likewise, also a grounded surface ("counter electrode") is conductive. Further, preferably the material of the surface to be charged has a resistivity of $1.10^{-10}$ Ω·m (at 20° C.) or less. Preferably, the material has a resistivity of $1.10^{-9}$ Ω·m (at 20° C.) or less, more preferably the material has a resistivity of $2.10^{-8}$ Ω·m (at 20° C.) or less. The negatively charged surface is therefore preferably conductive.

Hence, the charged surface, i.e. the charged surface of the first and/or the second object, preferably independently comprise the surface of a plate, a needle, a wire, such as a parabolic or circular wire, a wire mesh (like wire netting or wire gauze), a cable, an antenna, etc. Hence, the first and/or second object may independently have one or more objects such as plate, a needle, a wire, such as a parabolic or circular wire, a wire mesh (like wire netting or wire gauze), a cable, an antenna, etc. which are part of or integrated with the first and/or second object, respectively.

Further, in an embodiment the invention provides a combination of a particle catch arrangement according to the invention and a road wherein the particle catch arrangement is arranged to apply an electric field over at least part of the road. Herein, road again also includes for instance open place, etc. The particle catch arrangement may further comprise a positively charged surface, that may be arranged over the road, opposite of the negatively charged surface (opposite relative to a negatively charged surface arranged at a road side) or may be arranged in the middle of the road. The positively and negatively charged surfaces thereby form a capacitor (with air as dielectric). Further, in a specific embodiment, there is provided such combination, wherein a dielectric comprising air between the positively charged surface and the negatively charged surface of the particle catch arrangement is arranged over at least part of the road. Alternatively, but less preferred, instead of a negatively charged surface, a grounded surface is applied.

Hence, the invention provides a smut and exhaust gas particle etc. catch arrangement with induced static electric fields with a high voltage on for instance sound barriers (sound killers) along roads. The smut, fine dust and exhaust gas particle catch arrangement can be built as an application on existing sound barriers or other street furniture, or may be integrated in old or new street furniture and attract the pollution particles to the negatively charged surface of the arrangement.

Below, some embodiments are described in more detail with references to the figures. The figures are schematic and only show the essential elements for understanding the invention.

FIG. 1 describes a setup used in an experiment. This experiment is described below.

Figure 2A:
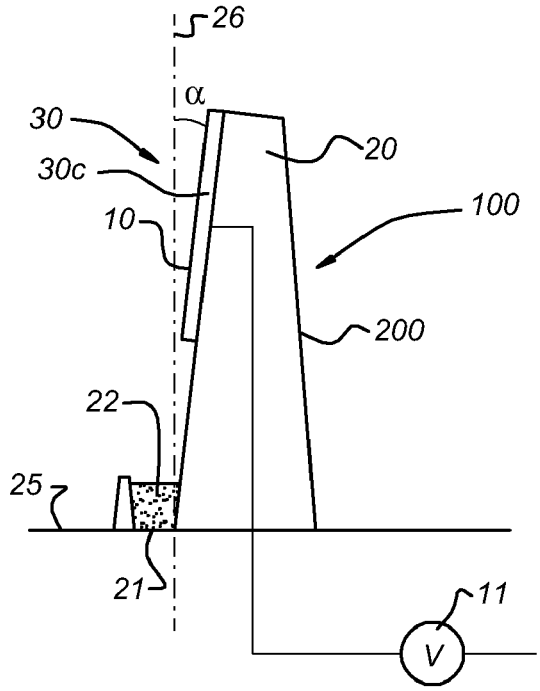
Figure 2B:
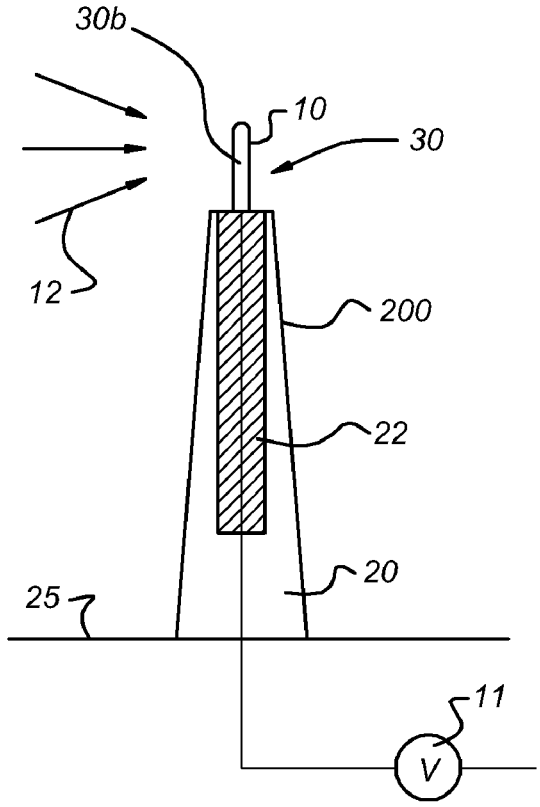
Figure 2C:
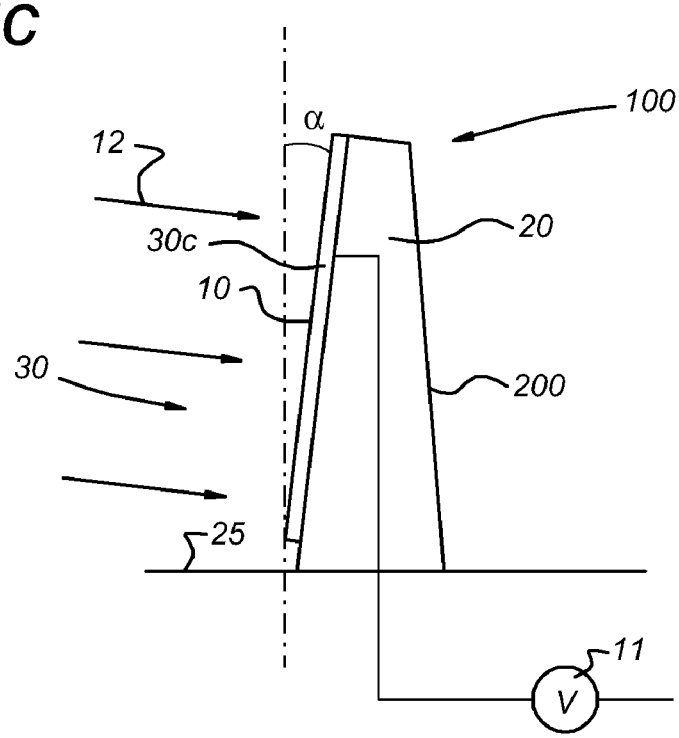

FIGS. 2*a*-*c* schematically show a side view of a number of embodiments according to the invention of a sound barrier object comprising the particle catch arrangement according to the invention.

FIG. 2*a* schematically shows a sound barrier 200 as street furniture object 100, arranged next to a road 25. The street barrier 200 further comprises particle catch arrangement 30, which comprises a generator 11 for generating a negatively charged surface 10. Here, charged surface 10 may be the surface of a plate 30*c* (although also any other object may be chosen, such as a wire, a plurality of wires, a wire mesh, etc.), which is conductive. Due to this charged surface 10 an electric field is created. Preferably, when using charged surface 10 with flat characteristics, such surface 10 is preferably arranged with an angle α relative to a normal to the earth's surface larger than 0° and smaller than 90°. In this way, rainwater may naturally wash surface 10. Particles collected on surface 10 may migrate downwards due to gravity or due to rainwater, and may optionally be collected in a gutter 21. This gutter may further optionally comprise an adsorbent 22. Hence, to this end object 200 to which particle catch arrangement 30 is arranged, may further comprise gutter 21 and/or an adsorbent 22. Herein the term "is arrange to" refers to arrangement wherein surface 10 (charged or to be charged) is attached to or integrated with a street object. For instance, an iron plate as surface 10 may be attached to a street barrier 200. In this and other embodiments, particle catch arrangement 30 comprises generator 11 which is arranged to apply a voltage of 1-50 kV to the surface that can be charged 10, preferably 1.5-50 kV.

FIG. 2*b* schematically shows a similar arrangement, however with a difference that surface 10 of particle catch arrangement 30 is arranged on top of sound barrier 200 (object 20). Preferably, particle catch arrangement 30 is arranged on a core or nucleus comprising adsorbent 22. The negatively charged surface 10 may be the surface of a plate 30*c* or a (blunt) needle 30*c* (as depicted), etc. The electric field lines of the generated electric field are indicated with reference 12 and extends over road 25, thereby ionizing particles (smut, fine dust, exhaust particles) and attracting them to charged surface 10. In a variant, adsorbent 22 may be exchanged when saturated.

FIG. 2*c* schematically shows a similar arrangement as shown in FIG. 2*a*. Here surface 10 (of for instance a plate 30*c*) substantially extends over the whole surface of sound barrier 200 that is directed to road 25.

FIGS. 3*a*-3*d* schematically show a number of other embodiments according to the invention of objects comprising the particle catch arrangement 30 according to the invention.

Figure 3A:
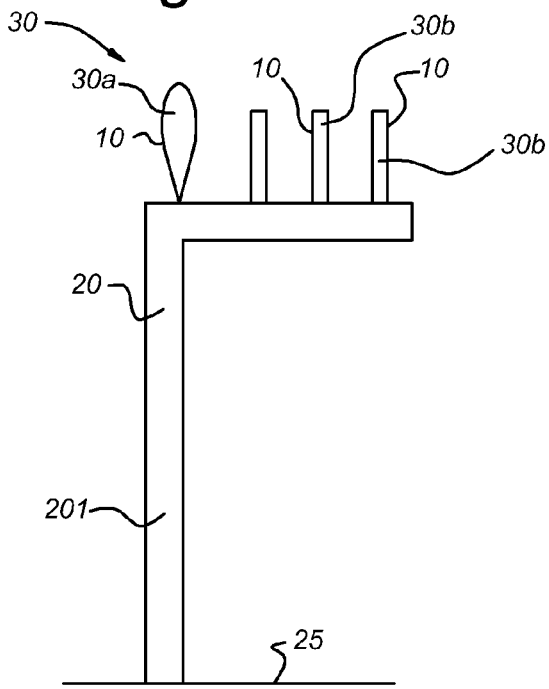

In FIG. 3*a*, object 20 comprises a lamp post or street light 201. Particle catch arrangement 30 may for instance be arranged to lamp post 201, such that negatively charged surface 10 is arranged on top of lamp post 201. For instance, the charged surfaces 10 may be the surfaces of a plate, a needle (like schematically indicated with reference number 30*b*), a circular or parabolic arranged wire (like schematically indicated with reference number 30*a*), etc. As will be clear to the person skilled in the art, one or more particle catch arrangements 30 (i.e. 30*a*, 30*b*, etc.) may be arranged to one street furniture object 100. Hence, the object 20 is street furniture 100, here lamp post 201, and the particle catch arrangement 30 comprises an object with a chargeable surface 10, such as a plate 30*c*, a wire 30*a* or a needle 30*b*, integrated with or part of the street furniture 100.

Figure 3B:
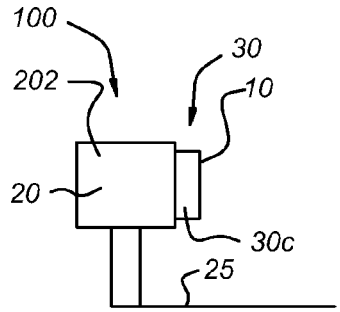

In FIG. 3*b*, object 20 comprises a crash barrier 202. Particle catch arrangement 30 may for instance be arranged to crash barrier 202, such that charged surface 10 is arranged sideways, directed to road 25. For instance, the charged surface 10 may be the surface of a plate 30*c*. Hence, the object 20 is street furniture 100, here crash barrier 202, and the particle catch arrangement 30 comprises an object with a chargeable surface 10, such as a plate 30*c*, integrated with or part of the street furniture 100.

Figure 3C:
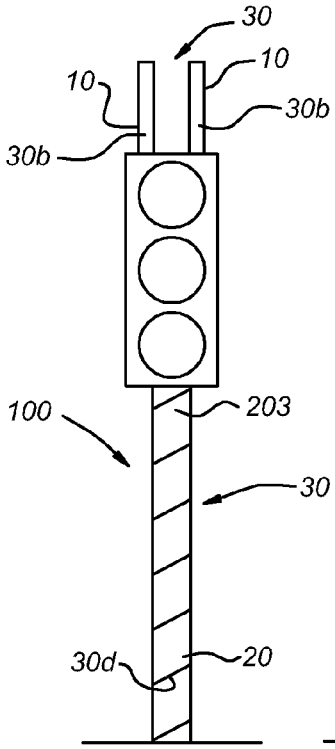

In FIG. 3*c*, object 20 comprises a traffic light 203. Particle catch arrangement 30 may for instance be arranged to traffic light 203, such that charged surface 10 comprises a needle like shape 30*b*, a circular or parabolic shape 30*a* (not depicted in FIG. 3*c*), etc. Further, charged surface 10 may comprise the surface of a wire mesh 30*d* (like wire netting or wire gauze). Hence, the object 20 is street furniture 100, here traffic light 203, and the particle catch arrangement 30 comprises an object with a chargeable surface 10, such as needle 30*b*, integrated with or part of the street furniture 100.

Figure 3D:
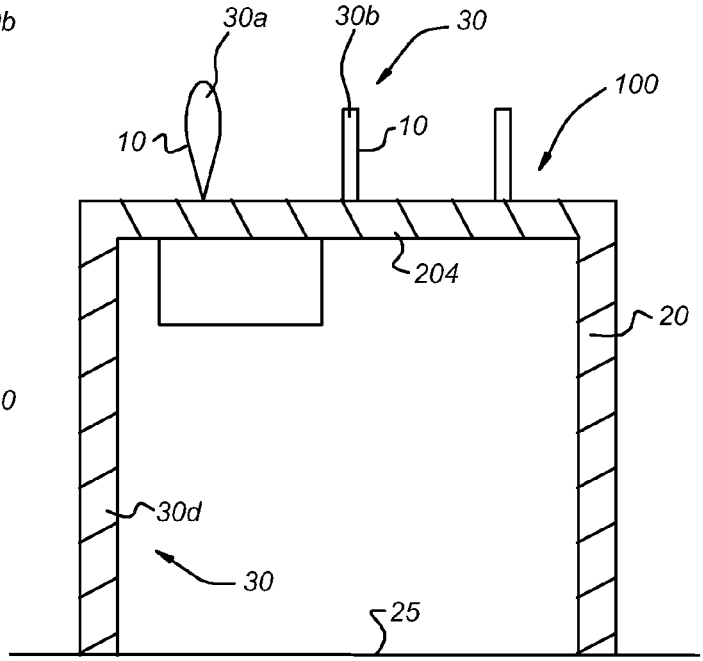

Further, FIG. 3*d* schematically shows a traffic information system 204 as object 20, here comprising a bridge type arrangement, at least partially bridging road 25, with for instance a board displaying for instance traffic information, prescribed speed, etc. Object 20 may comprise a needle like shape 30*b*, a circular or parabolic shape 30*a*, the surface of a wire mesh 30*d* (like wire netting or wire gauze), etc. Hence, the object 20 is street furniture 100, here traffic information system 204, and the particle catch arrangement 30 comprises an object with a chargeable surface 10 such as needle 30*b* or wire 30*a*, integrated with or part of the street furniture 100.

Preferably, particle catch arrangement 30, as especially depicted in FIGS. 3*a*, 3*c* and 3*d* as arrangements 30*a* and 30*b*, arranged on top of objects 20 (i.e. here objects 201, 203 and 204, respectively, and similar objects).

Hence, when particle catch arrangement 30 is provided next to a road 25 or over a road 25, the polluted air present (above the road 25) is cleaned by the method of the invention. Smut, fined dust and exhaust gasses are at least partially removed due to the fact that they are attracted to the negatively charged surface 10 of the particle catch arrangement 30. Over a distance of at least 0.5 m form the charged surface 10, pollution particles are attracted to the surface and "harvested" at the particle catch arrangement 30. Advantageously, gutter 21 or adsorbent 22 or gutter 21 comprising adsorbent 22 may be arranged below charged surface 10 such that pollution particles can be collected in or by such gutter 21 or adsorbent 22 when pollution particles fall down from surface 10 due to gravity, for instance due to rainfall washing the particles from surface 10.

Figure 4A:
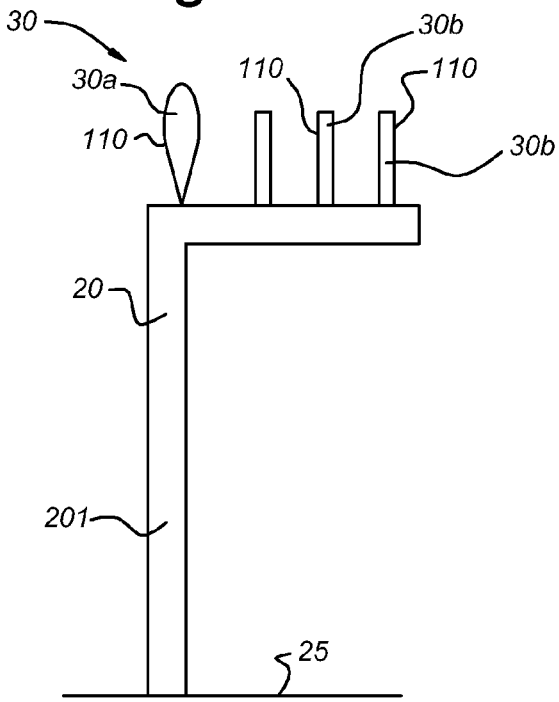
Figure 4B:
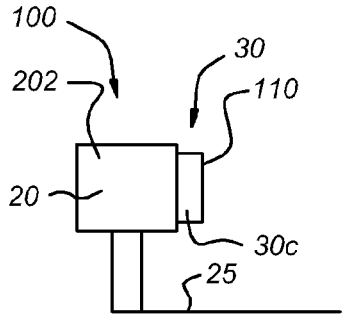
Figure 4C:
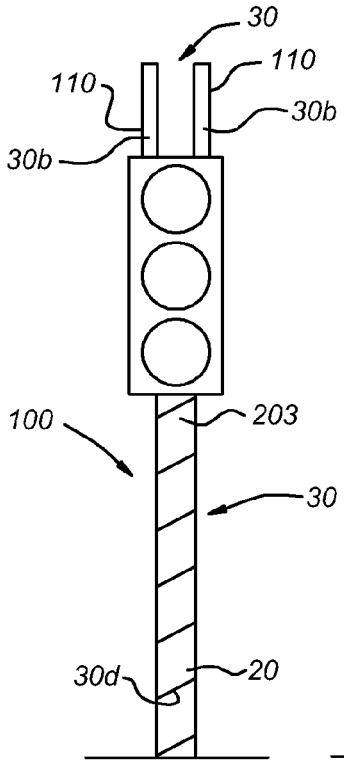
Figure 4D:
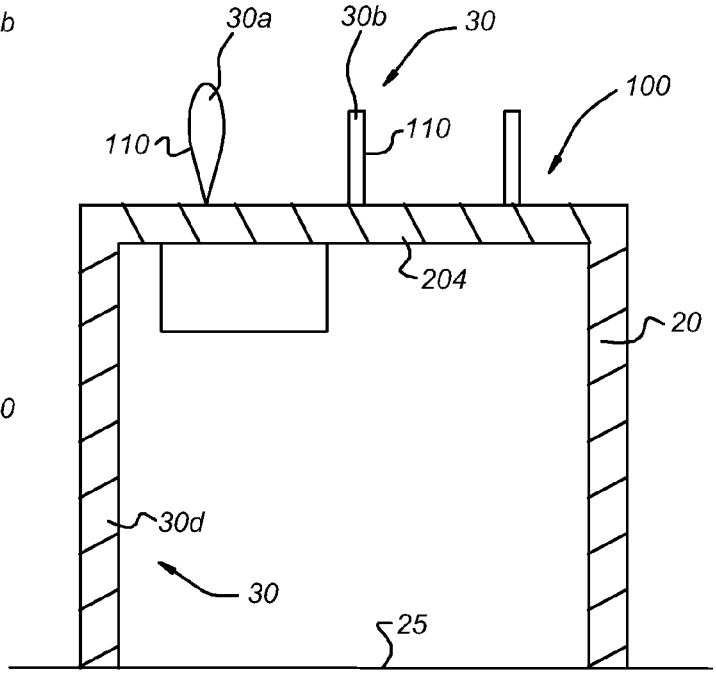

FIGS. 4*a*-4*d* schematically show a number of other embodiments according to the invention of objects comprising the particle catch arrangement 30 according to the invention, analogues to the embodiments described above, but wherein the charged surface 110 is a positively charged surface 110. Examples of street furniture 100 are depicted. In FIG. 4*a*, the object 20 is street furniture 100, here lamp post 201, and the particle catch arrangement 30 comprises an object with a chargeable surface 110, such as a plate 30*c*, a wire 30*a* or a needle 30*b*, integrated with or part of the street furniture 100. In FIG. 4*b*, the object 20 is street furniture 100, here crash barrier 202, and the particle catch arrangement 30 comprises an object with a chargeable surface 110, such as a plate 30*c*, integrated with or part of the street furniture 100. In FIG. 4*c*, the object 20 is street furniture 100, here traffic light 203, and the particle catch arrangement 30 comprises an object with a chargeable surface 110, such as needle 30*b*, integrated with or part of the street furniture 100. In FIG. 4*d*, the object 20 is street furniture 100, here traffic information system 204, and the particle catch arrangement 30 comprises an object with a chargeable surface 110 such as needle 30*b* or wire 30*a*, integrated with or part of the street furniture 100.

Preferably, particle catch arrangement 30, as especially depicted in FIGS. 4*a*, 4*c* and 4*d* as arrangements 30*a* and 30*b*, arranged on top of objects 20 (i.e. here objects 201, 203 and 204, respectively, and similar objects).

Hence, when particle catch arrangement 30 is provided next to a road 25 or over a road 25, the polluted air present (above the road 25) is cleaned by the method of the invention. Smut, fined dust and exhaust gasses are at least partially removed due to the fact that they are attracted to a negatively charged or grounded surface 10 (not depicted) in the vicinity of the particle catch arrangement 30. In this way, particle are harvested and cannot easily move away. Preferably, the particle catch arrangement further comprises a negatively charged surface 10 (counter electrode). Especially at such surface 10, the pollution particles can be harvested. Hence, especially combinations of embodiments of (1) positively charged surfaces 110 as schematically depicted in FIGS. 4*a*-4*d* and grounded or negatively charged surfaces 10 as schematically depicted in FIGS. 3*a*-3*d* will provide efficient particle catch arrangements 30. This is further explained below with reference to FIGS. 5*a*-5*d*.

For the sake of understanding, in the following preferred embodiments, a first object is indicated with reference number 120. Such object has a surface 110 that is positively charged. Further, a second object is indicated with reference number 20. Such object 20 has a surface 10, that is negatively charged or grounded (earthed).

Figure 5A:
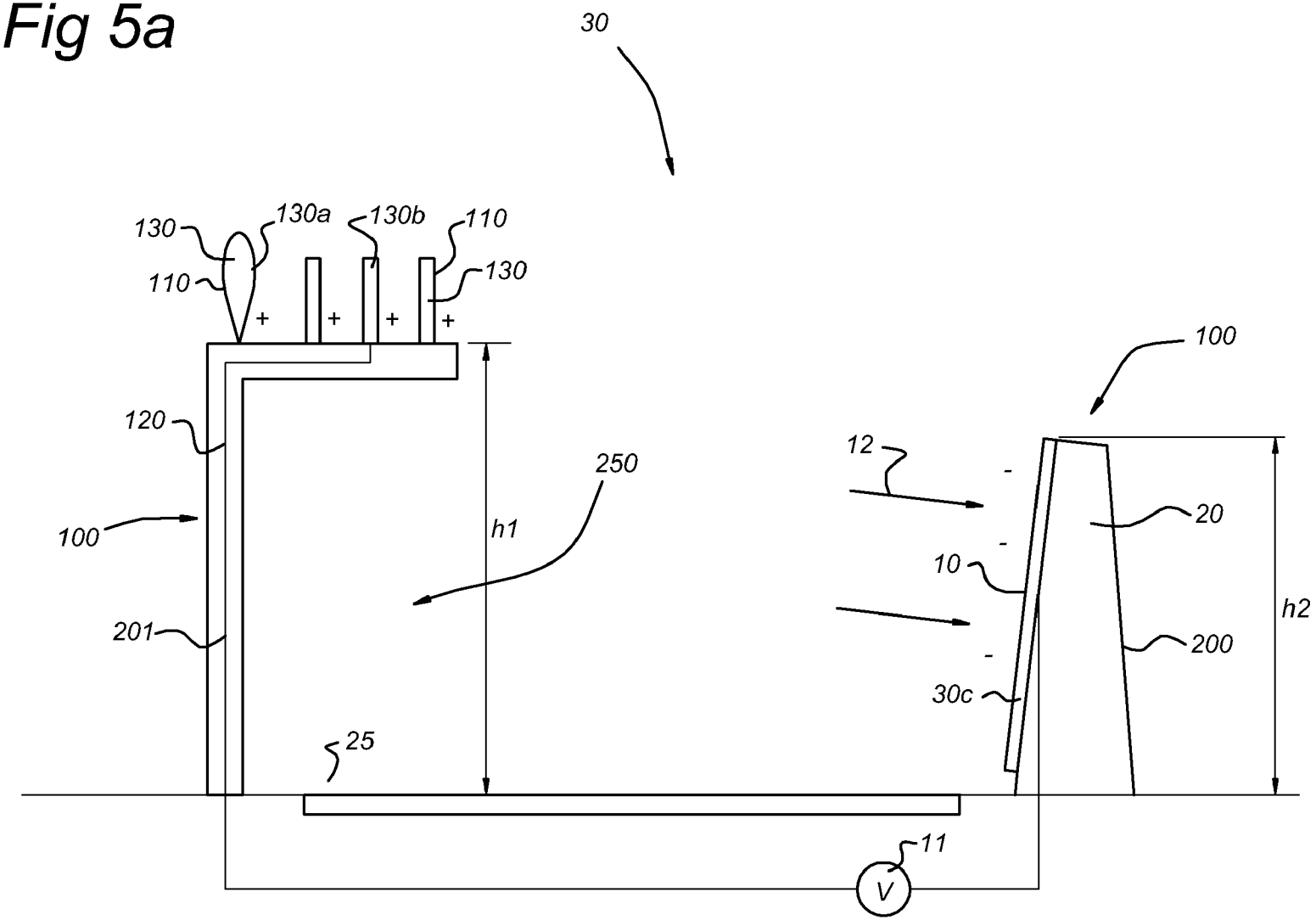

FIG. 5*a* schematically depicts an embodiment wherein field 12 is applied over a road, open place, etc. indicated with reference number 25. At one side (right in the drawing) of the road 25 (or open place, etc.), particle catch arrangement 30 is provided. In this embodiment, sound barrier 200 is depicted, but this may also be another piece of street furniture 100, for instance a crash barrier 202, a tunnel wall (se below), a road sign, a traffic information system 204, street light 201 or traffic light 203, etc. Surface 10 of particle catch arrangement 30 is negatively charged. Opposite (relative to road or open place 25) of negatively charged surface 10 at the right sight in the drawing, one or more objects are present that may be positively charged. In this figure, objects 120 with surfaces 110, may be the same objects and surfaces, respectively as indicated herein as object 30*a*, 30*b*, 30*c* or 30*d*, but now positively charged. Hence, they represent in this embodiment a part of particle catch arrangement 30, that is arranged to generate a positively charged surface 110. Hereby, field 12 is provided over road, open place etc. 25, which may lead to ionization of pollution particles, thereby drawing these particles to the negatively charged surface 10 of particle catch arrangement 30 positioned at one side of road or open place 25 (right in the drawing), and thus removing them from the air.

Hence, in a specific embodiment, there is provided particle catch arrangement 30 comprising surface 10 that can be charged (negatively charged), further comprising generator 11 arranged to generate charge to the surface 10 that can be charged and to generate a static electric field 12 of at least 0.2 kV/m, wherein the particle catch arrangement 30 is part of or integrated with an object comprising street furniture 100, for instance a sound barrier, a crash barrier, a tunnel wall, a road sign, a traffic information system or a traffic light, and wherein an object 130 comprising a positively charged surface 110 is arranged at a position selected from the group consisting of a) over road, open place 25, b) in the middle of road, open place, 25 (for instance as middle crash barrier, or street light for instance located at a central reservation or median strip, or c) at a position opposite to particle catch arrangement 30. In FIG. 5*a*, the object(s) 130 with positively charged surface(s) 110 (left) are arranged over road 25 and also opposite of particle catch arrangement 30 (right). Hence, in the schematic drawing of FIG. 5*a*, a combination of road 25 and particle catch arrangement 30 is depicted, wherein the particle catch arrangement 30 is arranged to apply an electric field 12 over at least part of the road 25.

Hence, particle catch arrangement 30 comprises a capacitor, with a negatively charged surface 10, which is preferably part of or integrated with street furniture, and a positively charged surface 110, which may in an embodiment be arranged over, opposite, or in the middle of road 25. Generator 11 may be used to charge surface 10 negatively and surface 110 positively, as will be clear to the person skilled in the art In case positively charged surface 110 is arranged in the middle of road 25 (for instance located at a central reservation or median strip), preferably a second particle catch arrangement 30 is arranged at the opposite (relative to road 25) a first particle catch arrangement 30. As will be clear to the person skilled in the art, when using an arrangement with a charged surface arranged in the middle of the road or open place 25, the invention also includes an embodiment with one or more negatively charged surfaces 10 in the middle of the road or open place 25, and one or more charged surfaces over or alongside of the road or open place 25.

Therefore, in a specific embodiment, a dielectric 250 of air between positively charged surface 110 and negatively charged surface 10 of particle catch arrangement 30 is arranged over at least part of the road. This means that the gap bridged by a pair of negatively and positively charged surfaces 10 and 110, respectively, bridges at least part of the surface over road (or open place) 25. Hence, the particle catch arrangement 30, at least during use, is arranged to have at least part of the geographical object, here road 25, between the first object 120 with charged surface 110 and the second object with charged or grounded surface 10.

Preferably, the object(s) 130 are arranged such that the shortest distance between the positively charged surfaces and the traffic is at least 0.5 m, preferably at least 1.0 m. In an embodiment, object(s) 130 with positively charged surfaces 110 are arranged on top of street furniture 100 such as traffic lights 203, signposts 204 and street lamps 201, similar as depicted in FIGS. 31, 3*c* and 3*d* for objects 30 (especially 30*a* and/or 30*b*), more preferably at a height that a shortest distance between positively charged surface 130 and the top of traffic (including trucks, busses, etc., or also trains) with maximum allowable height (according to local law) is at least 0.5 m, preferably at least 1.0 m. Hence, in this way the shortest distance between the top (i.e. maximum height) of traffic and the positively charged surface 110 is at least 0.5 m, preferably at least 1.0 m.

As will be clear to the person skilled in the art, one or more objects 130 (i.e. 130*a*, 130*b*, etc.) with positively charged surfaces 110 comprised in particle catch arrangement 30 according to the invention may be used an may for instance be arranged to street furniture object 100.

The negatively charged surface 10 is preferably not earthed. However, in an embodiment surface 10 may also be grounded.

Hence, with the invention substantially all pollution particles will be ionized on a distance, and will once be caught by the particle catch arrangement. $NO_x$, when hydrated will also be ionized on a distance and may be attracted in the same manner. The embodiment of FIG. 5*a* is not limited to the specific wires 130*a*, needles 130*b* and plate 30*c* as depicted. Other objects may alternatively or additionally be arranged to or integrated with the first object 120 and second object 20, respectively.

Figure 5B:
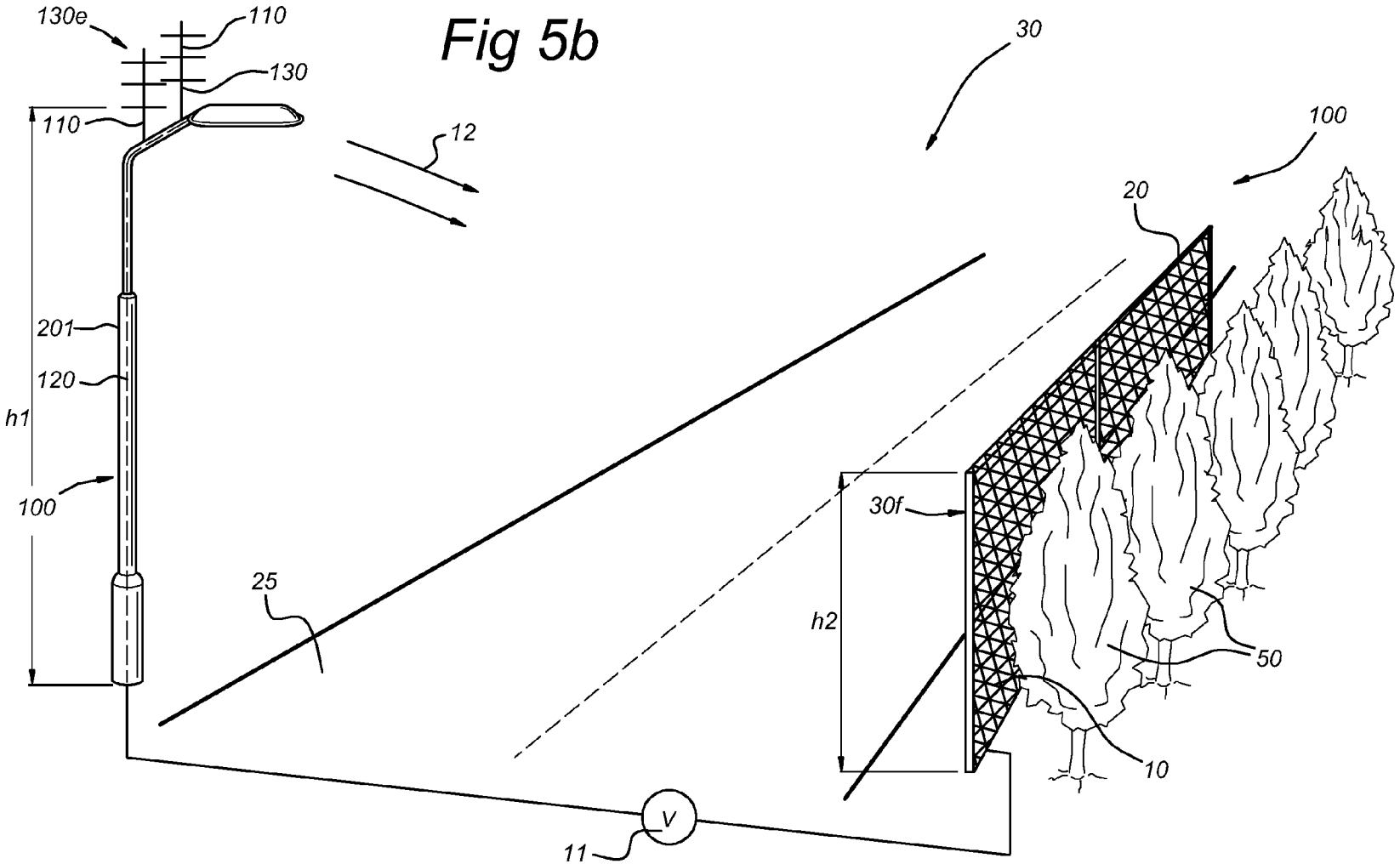

FIG. 5*b* shows a similar schematic embodiment as schematically depicted in FIG. 5*a*. However, here, the first objects 120 are by way of example antenna like objects 130*e*. Further, the counter electrode is here a is a fencing like object 30*f*, that is preferably negatively charged, with a grid like wire system. Downstream, relative to the field 12, of the object 30*f* with the negatively charged surface 10, a hedge 50 is provided. The combination of a fence 30*f* and hedge 50 as street furniture 100 may especially provide the catching function of the method of the invention. The embodiment of FIG. 5*b* is not limited to the specific antennas 130*e* and wire mesh 30*f* as depicted. Other objects may alternatively or additionally be arranged to or integrated with the first object 120 and second object 20, respectively. Surface 10 of second object 20, i.e. the surface 10 of wire mesh 30*f*, may be earthed or may be negatively charged.

Figure 5C:
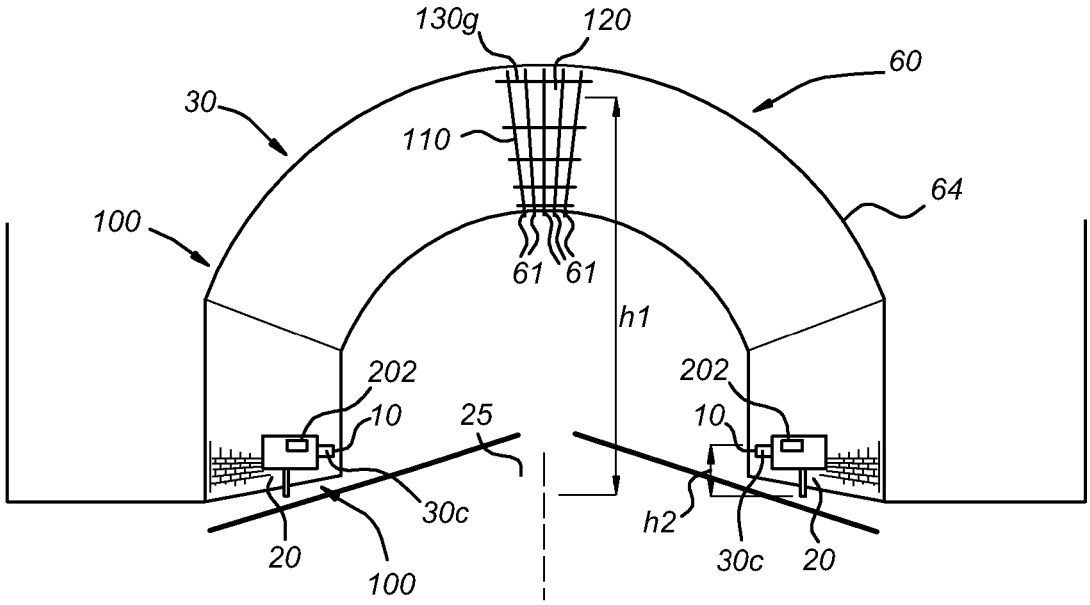

FIG. 5*c* schematically depicts in side view a tunnel 60 with tunnel wall 64. Crash barriers 202 with preferably negatively charged surfaces 10 and a positively charged surface 110 of a wire system 130*g* are used as particle catch arrangement 30. The wire system 130*g* may comprise a number of substantially parallel wires 61, with positively charged surfaces 110. They are in this embodiment arranged at a height h1 larger than height h2 of the negatively charged surfaces 10. The embodiment of FIG. 5*c* is not limited to the specific wire system 130*g* and plates 30*c* as depicted. Other objects may alternatively or additionally be arranged to or integrated with the first object 120 (i.e. tunnel wall 64) and second object 20, respectively. Surface 10 of second object 20, i.e. the surface 10 of plates 30*c*, may be earthed or may be negatively charged. In an alternative embodiment, for instance, a wire system or a wire mesh is also applied to one or more second objects 20.

Figure 5D:
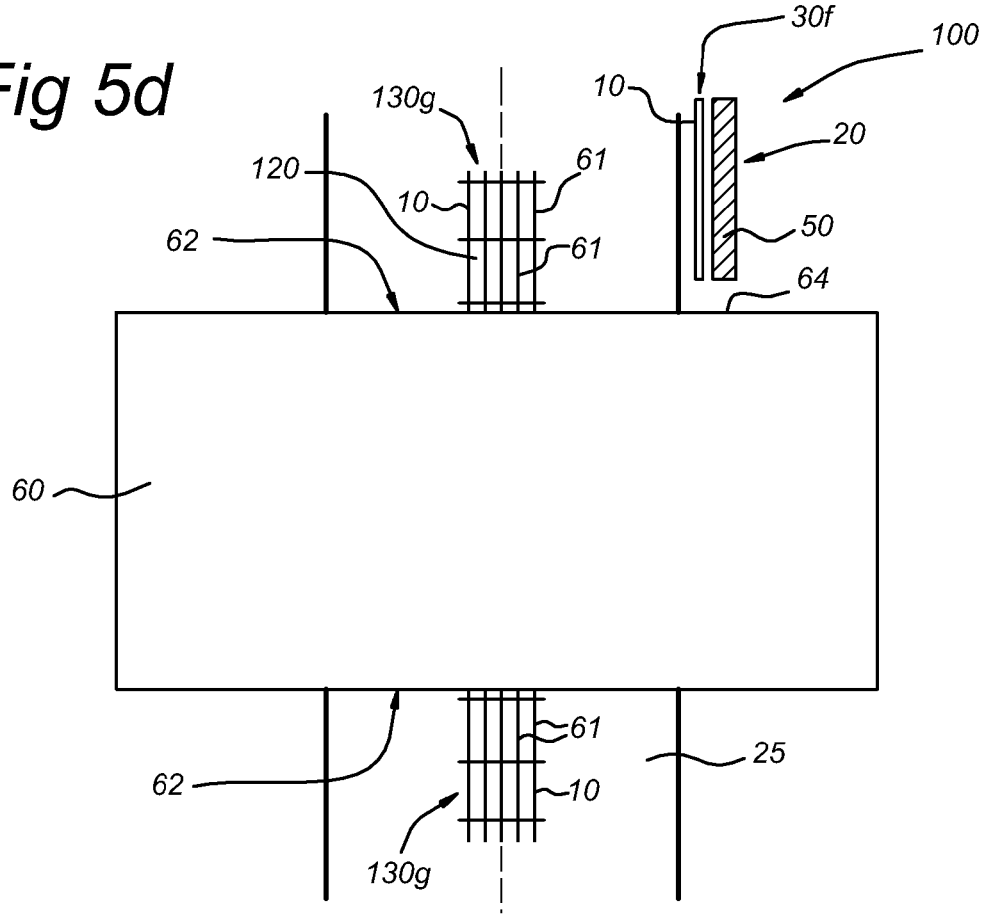

FIG. 5*d* schematically shows in top view a tunnel 60 with openings 62 and a similar wire system 130*g* as describe above, which may (also) be arranged outside the tunnel. Further, a counter electrode 30*f* as and optional hedge 50 as described above may be arranged at a side or both sides of the road. The embodiment of FIG. 5*d* is not limited to the specific wire system 130*g* and plates 30*c* (and hedge(s) 50) as depicted. Other objects may alternatively or additionally be arranged to or integrated with the first object 120 (i.e. tunnel wall 64) and second object 20, respectively. Surface 10 of second object 20, i.e. the surface 10 of plates 30*c*, may be earthed or may be negatively charged. In an alternative embodiment, for instance, a wire system or a wire mesh is also applied to one or more second objects 20.

Note that the wire system 130*g* or the antennas 130*e* and the wire mesh 30*f* are not limited to the specific embodiments schematically depicted herein wherein these objects are arranged to or integrated with first object 120 and second object 20, respectively. For instance, second object 120 may also comprise a wire system with a grounded or negatively charged surface 10; likewise, also first object 120 may comprise a wire mesh (gauze) with positively charged surface 110 (not depicted herein).

Hence, the invention provides in an embodiment a particle catch arrangement 30 comprising a first object 120 with a surface 110 that is chargeable and a second object 20 with a surface 10 that is chargeable (which surface 10 may optionally be grounded), wherein the particle catch arrangement further comprises a generator 11 arranged to generate charge to at least surface 110 of the first object, and arranged to generate a static electric field 12 of at least 0.2 kV/m between the surfaces 10,110. The invention further provides a method wherein the particle catch arrangement 30, as described herein, is used for application of the electric field over at least part of a geographical object selected from the group consisting of a road, an open place and a built-on area. Hence, when the particle catch arrangement 30 is in use, the first and second objects 120,20 are arranged to have at least part of the geographical object between the first and second objects (see also FIGS. 5*a*-5*d*). Preferably, the height h1 of the surface 110 of the first object 120 above the earth's surface below the surface 110 is larger than the height h2 of the surface 10 of the second object 20 above the earth surface. These heights may be mean heights, but may also be, as indicated in the figures, the lowest height of the surface 110 of the first object 120 above the earth's surface and the highest height of the surface 10 of the second object 20 above the earth's surface, respectively. In an embodiment, the (during operation) positively charged surface 110 is arranged at a height h1 of at least 5 m over a geographical object selected from the group consisting of a road, an open place and a built-on area (relative to the earth's surface below the surface 110).

The current through the system may be a measure of the particle catch efficiency.

As will be clear to the person skilled in the art, the counter electrode or object 30 with preferably a negatively charged surface may also be arranged in a central reserve (median strip) and the second objects 130 with the positively charged surfaces may be located at the roadside(s).

Further, the invention is not limited to road applications, but may also be applied to other geographical objects such as open places and a built-on areas.

Herein, the terms "charged surface", "negatively charged surface" and "positively charged surface" refer to surfaces of the particle catch arrangement during use thereof, i.e. when the field is applied. For instance, the phrase "charged surface comprising a surface of a conducting material" and similar phrases refer both to the surface during operation and to the particle catch arrangement not in operation; it only indicated that the surface during use of the arrangement is charged.

EXAMPLE

Referring to FIG. 1, the following experiment was performed. A 20 wt. % glycerol in ethanol mixture 2 was provided to a vessel 1. The mixture was fed to a hollow needle 3 such that needle 3 provides droplets one by one. The hollow needle 3 was arranged into an electric field, generated by source 4. The potential was about 4-7 kV (direct current). An aerosol 6 is provided with aerosol particles 7. These particles are fed to an opening 5 in a plate that is charged negatively. The needle was charged positively. Thereby, the aerosol particles 7 provided through opening 5 are neutral.

Subsequently, the aerosol particles 7 were fed (through opening 5) to an electric field 12, generated by a negatively charged plate 10 (direct current). The negative charge is generated by potential generator 11. The particle catch arrangement 30 comprises negatively charged surface 10 and generator 11 of the electric field 12. The potential applied was about 10 kV. The aerosol particles 7 were drawn to the surface and approximately 100% of the aerosol was caught. Preferably, surface 10 is flat. Alternatively, surface 10 was slightly bend or comprised for instance an arched geometry (for instance in the form of a circular or parabolic wire, etc.).

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims.

The invention claimed is:

1. A method for the removal of smut, fine dust and exhaust gas particles from polluted air, comprising: (i) providing a particle catch arrangement comprising a first object with a surface that can be charged, a second object with a surface that can be charged, a generator arranged to generate a positive charge to the first object's surface that can be charged and optionally a negative charge to the second object's surface that can be charged and to generate a static electric field of at least 0.2 kV/m between the surfaces, wherein at least part of the particle catch arrangement is part of or integrated with street furniture selected from the group consisting of a sound barrier, a crash barrier, a tunnel wall, a road sign, a traffic information system, a street lamp and a traffic light, and (ii) applying the static electric field over at least part of one or more geographical objects selected from the group consisting of a road, an open place and a built-on area, by applying a positive charge to the surface of the first object, thereby providing a positively charged surface, and wherein further a voltage of 1-50 kV is applied.

2. The method according to claim 1, further comprising applying a negative charge to a surface of the second object, thereby providing a negatively charged surface.

3. The method according to claim 2, wherein the surface charges are temporarily reversed for cleaning the surface of the second object.

4. The method according to claim 2, wherein the surface of the second object is grounded, and is the surface of a wire, a wire mesh, an antenna or a needle.

5. The method according to claim 1, wherein the electric field is applied over at least part of a road.

6. The method according to claim 1, further comprising washing the surface.

7. The method according to claim 1, wherein at least part of the smut, fine dust and exhaust gas particles are collected by an adsorbent comprised in the particle catch arrangement.

8. The method of claim 1, wherein the static electric filed is selected from the group consisting of (i) 0.2-50 kV/m, (ii) 0.2-2.5 kV/m, and (iii) at least 1.25 kV/m.

9. A particle catch arrangement for the removal of smut, fine dust and exhaust gas particles from polluted air, comprising: (a) a first object with a surface that can be charged, (b) a second object with a surface that can be charged, (c) a generator that generates (i) a positive charge to the first object's surface; (ii) a negative charge to the second object's surface; and (iii) a static electric field of at least 0.2 kV/m between the surfaces, wherein at least part of the particle catch arrangement is part of, or integrated with street furniture selected from the group consisting of a sound barrier, a crash barrier, a tunnel wall, a road sign, a traffic information system, a street lamp and a traffic light, and wherein the particle catch arrangement is arranged to apply the static electric field over at least part of one or more geographical objects selected from the group consisting of a road, an open place and a built-on area.

10. The particle catch arrangement according to claim 9, wherein the charged surface comprises a surface of a conducting material that comprises a plate having a surface of at least 0.01 $m^2$.

11. The particle catch arrangement according to claim 9, further comprising an adsorbent, arranged to collect at least part of the smut, fine dust and exhaust gas particles.

12. The particle catch arrangement according to claim 9 wherein the street furniture object is a sound barrier, a crash barrier, a tunnel wall, a road sign, a traffic information system, a street lamp or a traffic light.

13. The particle catch arrangement of claim 9, wherein a voltage of 1-50 kV is applied to the first object's surface.

14. A particle catch arrangement for the removal of smut, fine dust and exhaust gas particles from polluted air, comprising a surface that can be charged, and further comprising a generator that generates (a) charge to a surface that can be charged; and (b) a static electric field in the range of 0.2-2.5 kV/m, wherein the particle catch arrangement is part of or integrated with an object comprising street furniture, and wherein the particle catch arrangement is arranged to apply the static electric field over at least part of one or more geographical objects selected from the group consisting of a road, an open place and a built-on area.

15. The particle catch arrangement according to claim 14, wherein the charged surface is negatively charged during operation.

16. The particle catch arrangement according to claim 14, further comprising a second object, the surface of which is grounded.

17. The particle catch arrangement according to claim 14 wherein the street furniture object is a sound barrier, a crash barrier, a tunnel wall, a road sign, a traffic information system, a street lamp or a traffic light.

18. The particle catch arrangement according to claim 14 wherein the surface is the surface of a wire, a wire mesh, an antenna or a needle.

19. A particle catch arrangement for the removal of smut, fine dust and exhaust gas particles from polluted air, comprising: (a) a first object with a surface that can be charged, (b) a second object with a surface that can be charged, (c) a generator that generates (i) a positive charge to the first object's surface; (ii) a negative charge to the second object's surface; and (iii) a static electric field in the range of 0.2-2.5 kV/m between the surfaces, wherein at least part of the particle catch arrangement is part of, or integrated with, an object comprising street furniture, and wherein the particle catch arrangement is arranged to apply the static electric field over at least part of one or more geographical objects selected from the group consisting of a road, an open place and a built-on area, wherein the charged surface comprises a surface of a conducting material having a resistivity of $10^{-9}\Omega$ or less at 20° C.

20. A method for the removal of smut, fine dust and exhaust gas particles from polluted air comprising: (i) providing a particle catch arrangement comprising a first object with a surface that can be charged, a second object with a surface that can be charged, a generator arranged to generate a positive charge to the first object's surface that can be charged and optionally a negative charge to the second object's surface that can be charged and to generate a static electric field of at least 0.2 kV/m between the surfaces, wherein at least part of the particle catch arrangement is part of or integrated with an object comprising street furniture, and (ii) applying the static electric field over at least part of one or more geographical objects, by applying a positive charge to the surface of the first object, thereby providing a positively charged surface, and wherein further a voltage of 1-50 kV is applied.

21. The method of claim 20, wherein the method further comprises ionizing smut, fine dust and exhaust gas particles or inducing electric dipoles therein at a distance of at least 0.5 m from the positively-charged surfaces.

22. The method of claim 20, wherein the electric potential at the positively-charged surface of the first object is higher than the electric potential of the optionally-negatively-charged surface of the second object.

23. The method of claim 20, wherein the positively-charged surface of the object is at a height of at least 5 m over the geographical object.

24. The method of claim 20, wherein the method removes smut, fine dust and exhaust gas particles that are electrically neutral.

* * * * *